US011858683B2

(12) United States Patent
Latos et al.

(10) Patent No.: US 11,858,683 B2
(45) Date of Patent: Jan. 2, 2024

(54) RECLOSABLE LID OF A BEVERAGE CAN

(71) Applicant: CANPACK S.A., Cracow (PL)

(72) Inventors: Tomasz Latos, Cracow (PL); Leszek Wierzchowski, Cracow (PL)

(73) Assignee: CANPACK S.A., Cracow (PL)

( * ) Notice: Subject to any disclaimer, the term of this patent is extended or adjusted under 35 U.S.C. 154(b) by 213 days.

(21) Appl. No.: 17/295,037

(22) PCT Filed: Oct. 30, 2019

(86) PCT No.: PCT/IB2019/059295
§ 371 (c)(1),
(2) Date: May 18, 2021

(87) PCT Pub. No.: WO2020/099970
PCT Pub. Date: May 22, 2020

(65) Prior Publication Data

US 2021/0394956 A1 Dec. 23, 2021

(30) Foreign Application Priority Data

Nov. 14, 2018 (PL) ..... 427746

(51) Int. Cl.
*B65D 17/40* (2006.01)
*B65D 17/28* (2006.01)

(52) U.S. Cl.
CPC .. *B65D 17/4014* (2018.01); *B65D 2517/0014* (2013.01); *B65D 2517/0041* (2013.01)

(58) Field of Classification Search
CPC ..... B65D 17/404; B65D 17/4014; B65D 17/4012; B65D 17/401; B65D 17/4011;
(Continued)

(56) References Cited

U.S. PATENT DOCUMENTS 5,080,249 A * 1/1992 Shock ..... B65D 17/4014 220/258.2
2001/0019058 A1* 9/2001 Song ..... B65D 51/007 220/730

(Continued)

FOREIGN PATENT DOCUMENTS

DE 20206956 U1 * 9/2002 ..... B65D 17/165
DE 202008007456 U1 * 9/2008 ..... B65D 17/166

*Primary Examiner* — Robert J Hicks
(74) *Attorney, Agent, or Firm* — Andrzej Malarz, Esq.

(57) ABSTRACT

A reclosable metal lid of a beverage can comprising a centre panel in which scorelines are made, allowing to tear out an aperture, a circumferential panel connecting the centre panel with the neck of the can, and a pull-tab attached by a rivet, and a collar for connecting the lid with the can body, equipped with a closing rotatable panel rotating around the rivet axis is, wherein the centre panel (4) is above the circumferential panel (3) and has in the connection spot with the circumferential panel (3) an additional embossing forming a guide-rail, and the rotatable panel (5) is mounted on the lid on this guide-rail, while the pull tab (7) is affixed to the rotatable panel (5) by the rivet (6), wherein the size of the rotatable panel (5) corresponds to the size of the centre panel (4), and the rotatable panel (5) comprises an aperture which corresponds to a drinking opening of the lid.

6 Claims, 5 Drawing Sheets

Figure 1:
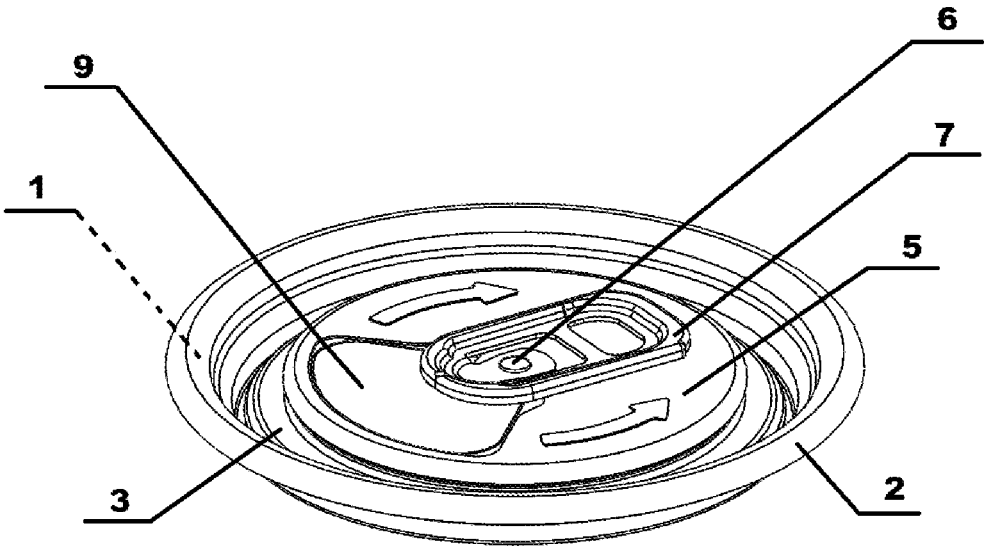

(58) Field of Classification Search
CPC ..... B65D 51/20; B65D 2517/0041; B65D 2517/004; B65D 2517/0031; B65D 2517/0022; B65D 2517/0023; B65D 2517/0014
USPC ..... 220/254.4, 258.2, 258.1, 254.9, 254.8, 220/254.1, 259.3, 345.1, 272, 270, 269, 220/268, 266, 265, 730, 212
See application file for complete search history.

(56) References Cited

U.S. PATENT DOCUMENTS

| | | | | |
|---|---|---|---|---|
| 2003/0000952 | A1* | 1/2003 | Dyren | B65D 17/4014 220/269 |
| 2005/0051553 | A1* | 3/2005 | Li | B65D 17/4014 220/730 |
| 2005/0211708 | A1* | 9/2005 | Thomas | B65D 17/4014 220/258.2 |
| 2009/0032531 | A1* | 2/2009 | Navare | B65D 17/4014 220/254.1 |

* cited by examiner

RECLOSABLE LID OF A BEVERAGE CAN

TECHNICAL FIELD

The object of the present invention is a reclosable metal lid of a beverage can comprising a centre panel having scorelines allowing to tear out an aperture, a circumferential panel connecting the centre panel with the neck of the can, a pull-tab attached by a rivet, and a collar for connecting the lid with the can body, equipped with a closing rotatable panel rotating around the rivet axis.

BACKGROUND OF THE INVENTION

Patent specification US2009032531 discloses a beverage can lid equipped with a rotatable cover (closing panel). The cover has the size corresponding to the lid. The rim of the lid is provided with a hook, that after being pushed onto the rim of the lid holds the cover on the lid. The cover is rotated to close the aperture torn out in the lid. The cover is the size of the approximately 50% of the lid surface.

Patent specification US2005051553 discloses a can lid with a cover, that essentially corresponds to the size of the aperture torn out in the can lid. From one side the cover is attached by a hook, and from the other side by a rivet serving to attach a pull tab. The cover rotates around the rivet axis.

The U.S. Pat. No. 6,290,084 discloses a can lid with a cover, where the lid corresponds to the size of the cover and on the rim has a hook of loop shape, that latches on the lid collar. The cover, before opening, covers the lid entirely. The cover is equipped with a pull ring, that allows to tear out its part in order to uncover a part of the lid, where there is a score line to tear out the aperture. The part of the cover remaining on the lid, after rotation, serves to close the aperture tom out in the lid.

Patent specification GB2482504 discloses a can lid with a fan-shaped cover. The cover is affixed by a rivet used for fixing the pull tab. The cover has raised studs, that prevent uncontrollable rotation around the rivet.

DISCLOSURE OF THE INVENTION

A reclosable metal lid of a beverage can comprising a centre panel having scorelines allowing to tear out an aperture, a circumferential panel connecting the centre panel with the neck of the can, a pull-tab attached by a rivet, and a collar for connecting the lid with the can body, equipped with a closing rotatable panel rotating around the rivet axis according to the invention is characterized in that, the centre panel is above the circumferential panel and has in the connection spot with the circumferential panel an embossing forming a guide-rail, and the rotatable panel is mounted on the lid on the guide-rail, while the pull tab is affixed to the rotatable panel by the rivet, wherein the size of the rotatable panel corresponds to the size of the centre panel, moreover there is an aperture in the rotatable panel. The rotatable panel on the entire length of its edge is bent to form a hook having a radius adjusted to the radius of the guide rail formed on the connection between the centre panel and the circumferential panel, to enable rotation of the rotatable panel around the rivet axis. Simultaneously this hook and the rivet are holding the rotatable panel on the centre panel.

The centre panel may have a bead in the centre. The bead causes wedging of the rotatable panel, as a result the rotatable panel is more tightly attached to the centre panel. Alternatively, in order to improve the connection between the centre panel and the rotatable panel it is possible to attach the rivet both to the rotatable panel and to the centre panel. In this case the neck of the rivet goes both through the rotatable panel and the centre panel. The mounting of the rivet must enable rotation of the rotatable panel around the rivet axis.

The rotatable panel has an aperture corresponding to the size of the scoreline for tearing out the aperture in the centre panel.

The scoreline for tearing out the aperture enables tearing out the aperture covering surface from 10% to 50% of the centre panel surface.

The scoreline for tearing out the aperture enables tearing out the aperture covering surface not smaller than 25% of the centre panel surface.

The radius R1 of the curvature of the surface in the connection spot of the centre panel and the circumferential panel is from 0.5 mm to 10 mm. The radius R2 of the rotatable panel is from 0.55 mm to 11 mm. The radius R2 is the radius of the hook formed on the edge of the rotatable panel.

The diameter of the rotatable panel is from 35 mm to 85 mm.

The beverage can lid is made of metal, preferably of aluminum alloy.

The rotatable panel may be made of metal, preferably of aluminum alloy. It may also be made of plastic or composite materials.

The can equipped with the lid according to the invention is opened in the following way:

1. The rotatable panel is rotated to the ON position, where the scoreline of the rotatable panel is above the scoreline of the lid.
2. The can is opened as in the case of a standard can.
3. The pull tab is pushed down and the beverage is drunk.
4. After drinking part of the beverage, the rotatable panel is rotated 180° closing the can.
5. In order to drink the beverage again, it is sufficient to turn the rotatable panel and to uncover the aperture in the can.

Advantages of such solution is possibility of drinking the beverage in portions. In addition, the closure of the can protects the beverage from pollution, including the prevention of insects entry into the can, and also prevents the rapid degassing of the drink, what increases the flavours of the drink.

In addition, raising the centre panel is aimed not only to enable the fixing of the rotatable panel, but also enables better fitting of the lids, that are packed into transport sleeves. In this way better fitting of approximately 30% was achieved in comparison to the lids known from the prior art. The rotatable panel used in the invention, as opposed to the panels used until now, that were partial panels, is a full panel covering the centre panel in its entirety, so that the centre panel is stiffened. Due to the fact that the rotatable panel additionally stiffens the lid, it is possible to use thinner metal sheet for lid's manufacturing than the standard metal sheet used in the solutions known from the prior art.

The object of the invention is disclosed at the drawings, where

Figure 2:
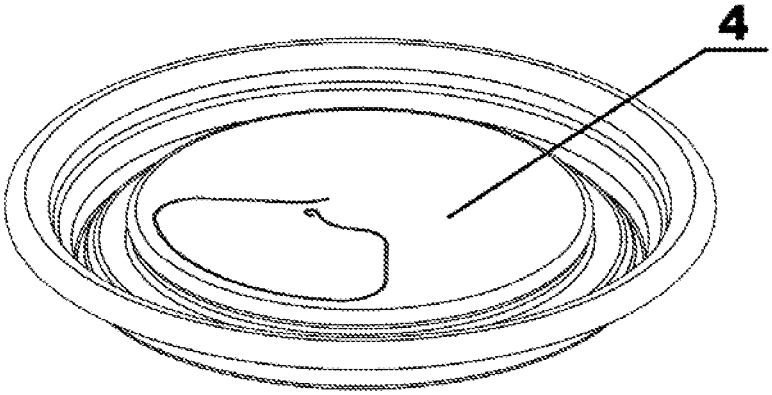
Figure 3:
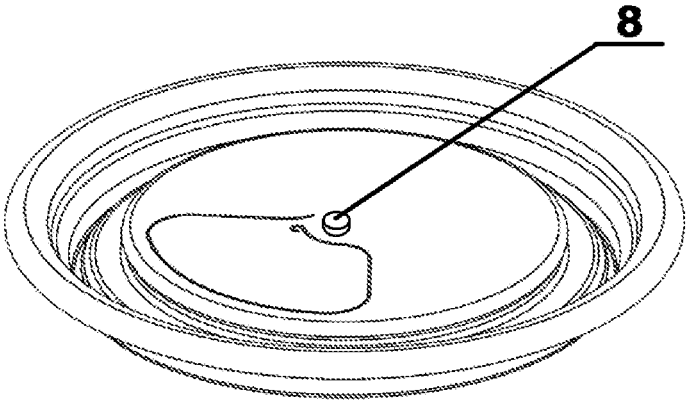
Figure 4:
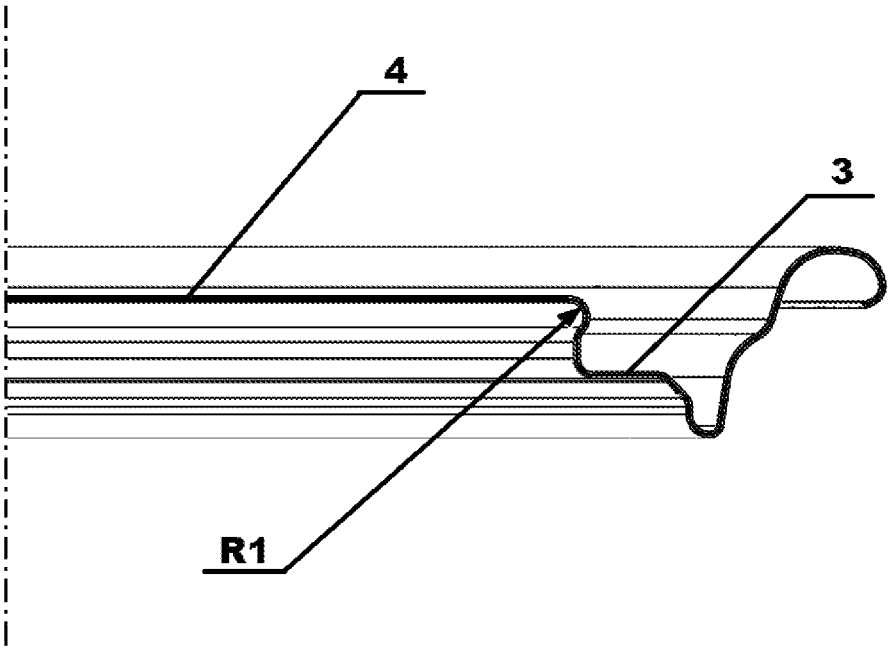
Figure 5:
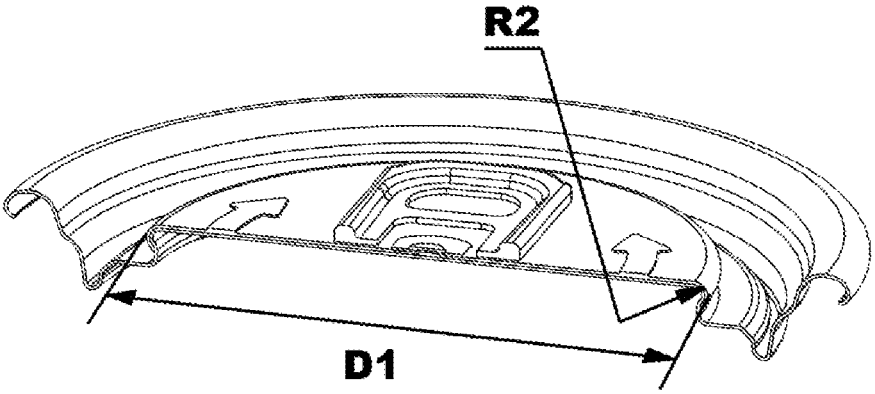
Figure 6:
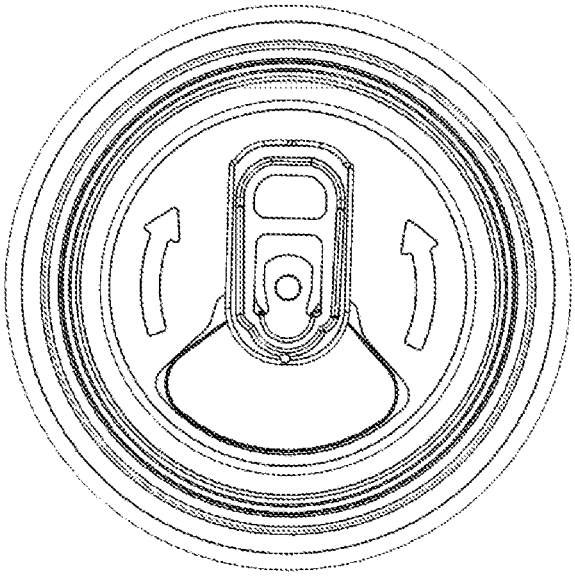
Figure 7:
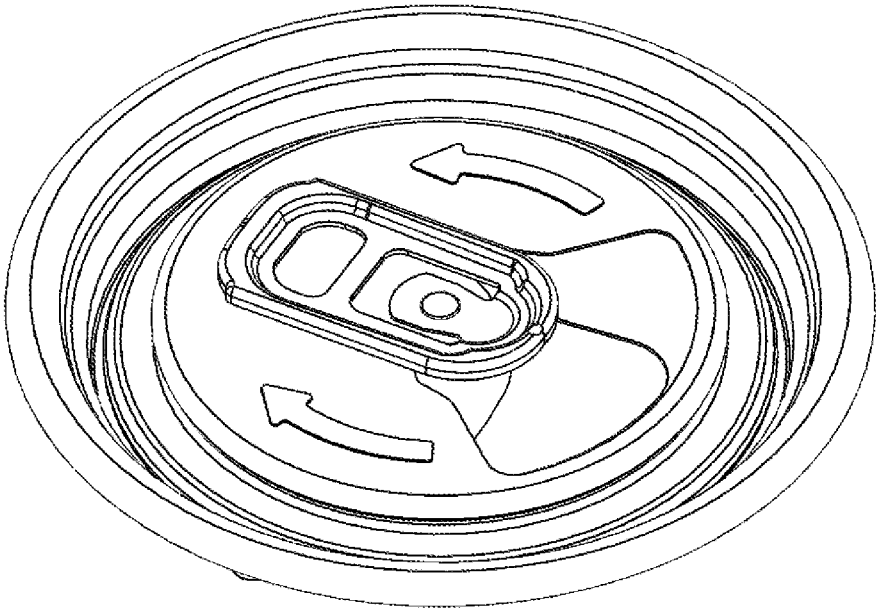
Figure 8:
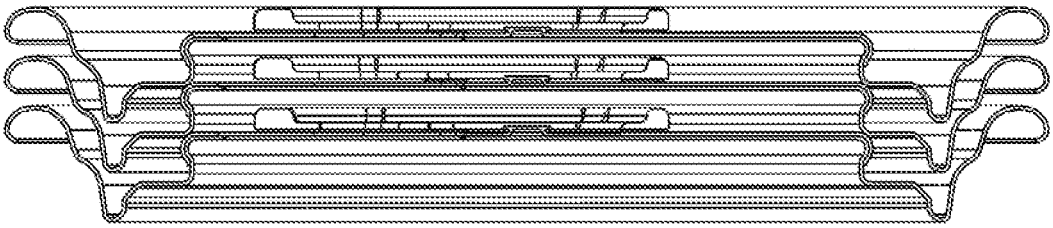
Figure 9:
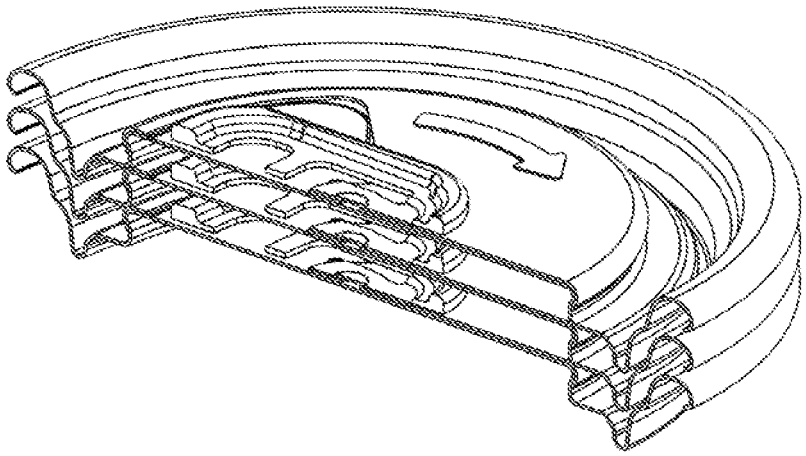

FIG. 1 illustrates the lid viewed from above with the rotatable panel,

FIG. 2 and FIG. 3 illustrate the lid viewed from above without the rotatable panel, FIG. 4 illustrate a cross section of the lid without the rotatable panel, FIG. 5 illustrate a cross section of the lid with the rotatable panel, FIG. 6 illustrate the lid with the rotatable panel in the closed position, FIG. 7 illustrate the lid with the rotatable panel in the partially opened position, FIG. 8 and FIG. 9 illustrate the lids stacked one the other.

EXAMPLE

The metal lid 1 of the beverage can consists of the collar 2, the circumferential panel 3 and the centre panel 4. The centre panel 4 is above the circumferential panel 3. In the centre panel a scoreline was made, that after tearing out will form an aperture serving for emptying the can. The rotatable panel 5 is mounted on the centre panel. The pull tab 7 is affixed to the rotatable panel 5 by the rivet 6. In addition the centre panel may have a bead 8 in the middle, on which the rotatable panel is wedged. Alternatively the neck of the rivet 6 may go through both the rotatable panel 5 and the centre panel 4. Nevertheless the mounting of the rivet 6 in this case must enable rotation of the rotatable panel 5 around the axis of the rivet 6. In the rotatable panel there is the aperture 9 size corresponding by size with the aperture torn out in the centre panel 4.

In the connection spot between the circumferential panel and the centre panel there is an additional embossing having radius R1 forming the guide-rail, that on one hand serves to mount the rotatable panel on the centre panel, and on the other hand is its guide-rail. The radius R1 of the curvature of the surface in the connection spot between the centre panel 4 and the circumferential panel 3 is from 0.5 mm to 10 mm. In turn, the radius R2 of the rotatable panel 5 is from 0.55 mm to 11 mm. R2 is the radius of the hitch made on the edge of the rotatable panel. The mutual appropriate adjustment of the radiuses of the guide rail radius and of the rotatable panel hitch causes, that the rotatable panel wedges on the centre panel, and then it may be set in rotational motion around the rivet.

The aperture in the rotatable panel corresponds with the aperture torn out in the centre panel. The aperture torn out in the centre panel is from 10 to 50% of the centre panel surface. Preferably the diameter D1 of the rotatable panel 5 is from 35 mm to 85 mm. The diameter of the centre panel corresponds with the diameter of the rotatable panel.

To open the can it is necessary to rotate the rotatable panel, so that the aperture in the rotatable panel is above the aperture in the centre panel. Then it is necessary to tear out the aperture in the centre panel lifting the pull tab so that the nose of the pull tab presses a part of the centre panel inside the can. In order to close the can the rotatable panel is rotated so that it covered the aperture in the centre panel. Reopening the can is carried out by rotating the rotatable panel so as to uncover the aperture in the centre panel.

Raising of the centre panel above the circumferential panel causes, that the lids stacked in a pile better adhere to each other. Owing to that it is easier to transport them, because they take less space.

The invention claimed is:

1. A reclosable metal lid of a beverage can body comprising: a centre panel in which scorelines are made, allowing to tear out an aperture, a circumferential panel, and a pull-tab attached by a rivet, and a collar for connecting the lid with the can body, equipped with a closing rotatable panel rotating around the rivet axis, wherein the centre panel (4) is above the circumferential panel (3) and has in the connection spot with the circumferential panel (3) an additional embossing forming a guide-rail, wherein a radius (R1) of curvature of a surface in a connection spot of the centre panel (4) and the circumferential panel (3) is from 0.5 mm to 10 mm and the rotatable panel (5) is mounted on the lid on this guide-rail, while the pull tab (7) is affixed to the rotatable panel (5) by the rivet (6), wherein the size of the rotatable panel (5) corresponds to the size of the centre panel (4), and moreover an aperture is in the rotatable panel (5), and the rotatable panel (5) has an aperture corresponding to the size of the scoreline for tearing out the aperture (9) in the centre panel (4), and wherein the scoreline for tearing out the aperture (9) enables tearing out the aperture covering surface from 10% to 50% of the centre panel (4) surface.

2. The lid according to claim 1, wherein the centre panel (4) has a bead (8).

3. The lid according to claim 1, wherein the rivet (6) is attached both to the rotatable panel (5), and to the centre panel (4).

4. The lid according to claim 1, wherein the scoreline for tearing out the aperture (6) enables tearing out the aperture covering surface not smaller than 25% of the centre panel (4) surface.

5. The lid according to claim 1, a radius (R2) of the rotatable panel (5) is from 0.55 mm to 11 mm.

6. The lid according to claim 5, wherein a diameter (D1) of the rotatable panel (5) is from 35 mm to 85 mm.

* * * * *